US007797773B1

(12) United States Patent
Wilk

(10) Patent No.: US 7,797,773 B1
(45) Date of Patent: Sep. 21, 2010

(54) NECK REST WITH ATTACHED HEAD SUPPORT

(76) Inventor: Peter J. Wilk, 400 E. 58th St., Apt. 34D, New York, NY (US) 10022

( * ) Notice: Subject to any disclaimer, the term of this patent is extended or adjusted under 35 U.S.C. 154(b) by 0 days.

(21) Appl. No.: 12/455,001

(22) Filed: May 27, 2009

(51) Int. Cl.
*A47G 9/10* (2006.01)

(52) U.S. Cl. ..... 5/640; 5/644

(58) Field of Classification Search ..... 5/636, 5/637, 640, 644, 645; 297/393
See application file for complete search history.

(56) References Cited

U.S. PATENT DOCUMENTS

| | | | | |
|---|---|---|---|---|
| 673,872 | A | 5/1901 | Hillern-Flinsch | |
| 2,589,155 | A | 3/1952 | Smith | |
| 3,017,221 | A | 1/1962 | Emery | |
| 3,608,964 | A | 9/1971 | Earl | |
| 4,031,578 | A | 6/1977 | Sweeney et al. | |
| 4,285,081 | A | 8/1981 | Price | |
| 4,738,488 | A | 4/1988 | Camelio | |
| D309,393 | S | 7/1990 | Talaugon | |
| 5,129,705 | A | 7/1992 | Wray | |
| 5,257,429 | A * | 11/1993 | Genis | 5/636 |
| 5,454,781 | A * | 10/1995 | Chitwood | 602/18 |
| 5,642,543 | A * | 7/1997 | Huntley | 5/640 |
| 6,216,298 | B1 | 4/2001 | Oliveira | |
| 6,457,195 | B1 | 10/2002 | Holste | |
| 6,779,211 | B1 * | 8/2004 | Williams | 5/655 |
| 2007/0033737 | A1 * | 2/2007 | Melton | 5/640 |

* cited by examiner

*Primary Examiner*—Michael Trettel
(74) *Attorney, Agent, or Firm*—R. Neil Sudol; Henry D. Coleman; William J. Sapone

(57) ABSTRACT

A neck rest includes a first body member and a second body member. The first body member has a first recess for receiving a user's neck and defines a cushion extending around the recess for at least partially surrounding the user's neck. The second body member is different from the first body member and connected to the first body member. The second body member defines a second recess for receiving at least a lower portion of the user's head. The second body member defines a cushion extending around the second recess for at least partially surrounding the lower portion of the user's head.

17 Claims, 1 Drawing Sheet

NECK REST WITH ATTACHED HEAD SUPPORT

BACKGROUND OF THE INVENTION

The present invention relates to a neck rest.

Neck rests are among the common appurtenances of air travelers and other people who are constrained to a more or less sitting position, even when they wish to sleep.

OBJECTS OF THE INVENTION

It is an object of the present invention to provide an improved neck rest.

A more particular object of the present invention is to provide a neck rest that is lightweight and easily transportable.

A further object of the present invention is to provide such a neck rest that is inexpensive to manufacture.

These and other objects of the present invention will be apparent from the drawings and descriptions herein.

SUMMARY OF THE INVENTION

The present invention generally provides a neck rest with an attached head support. The head support serves to restrain the head from lolling too far to either side. Optionally the head support may include a headband serving to restrain the head from bobbing or falling forward.

A neck rest assembly in accordance with the present invention comprises a first body member and a second body member. The first body member has a first recess for receiving a user's neck and defines a cushion extending around the recess for at least partially surrounding the user's neck. The second body member is different from the first body member and connected to the first body member. The second body member defines a second recess for receiving at least a lower portion of the user's head. The second body member defines a cushion extending around the second recess for at least partially surrounding the lower portion of the user's head.

Preferably, at least one of the first body member and the second body member is an inflatable balloon or bladder. In one embodiment of the invention, both body members are separately inflatable and have respective air inlet ports. In another embodiment of the invention, one of the body members is a bag at least partially filled with flowable solid particles, such as artificial or natural beans. In the latter case, it is preferably the first body member that is a bag at least partially filled with the flowable solid particles, while the second body member is an inflatable balloon or bladder Pursuant to another feature of the present invention, one body member may extend generally in a plane, while the other body member includes a plurality of support ribs extending substantially perpendicularly to the plane. The support ribs may take the form of seams dividing the second body member into a plurality of compartments. The compartments may have concave surfaces along an inner side of the second body member, facing into the second recess. In any event, for purposes of adding strength, the second body member may take a fluted, scalloped, or ribbed configuration.

In one embodiment of the present invention, both the first body member and the second body member are inflatable balloons or bladders. The first body members preferably have respective gas inlets so that the first body member and the second body member are separately inflatable. Thus, the neck rest assembly can be used only with the neck rest portion operational or with both the neck rest and the head support functional.

In accordance with another aspect of the present invention, the first body member is a C-shaped member having a first height, while the second body member having a semi-cylindrical shape with a second height greater than the first height.

In accordance with another aspect of the present invention, the first body member and the second body member are detachably connected to one another.

In an alternative embodiment of the invention, the first body member and the second body member are inflatable and share a single gas inlet so that the body members are jointly inflatable.

A combined head and neck rest in accordance with the present invention enables resting travelers to sleep longer, since the combined head and neck rest prevents the head from falling suddenly, waiting the user, or gradually, which might result in neck strain.

DETAILED DESCRIPTION

Figure 1:
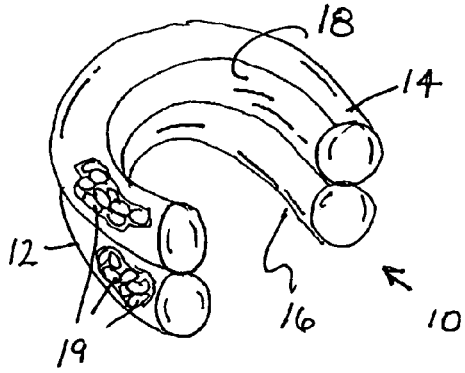
FIG. 1 is a schematic perspective view of a first embodiment of a combined neck rest and head support in accordance with the present invention.

FIG. 1 depicts a neck and head rest assembly 10 including a neck rest 12 with an attached head support 14 each in the form of a generally U- or C-shaped body member defining a respective recess or cutout 16 and 18. Neck rest 12 is configured to sit on a user's shoulders and surround the sides and back of the user's neck. Head support 14 is attached to neck rest 12 along one side thereof so as to be disposed generally coextensively therewith and parallel thereto. During use, head support 14 receives and substantially surrounds at least a lower portion of the user's head. Head support 14 serves to restrain the user's head from lolling too far to either side. Optionally the head support may include a headband (not shown) serving to restrain the head from bobbing or falling forward.

As depicted in broken-away view in FIG. 1, neck rest 12 and head support 14 may be filled with a fluidic particulate material such as natural or artificial beans 19. The artificial material may be polymeric foam material.

Neck rest 12 and head support 14 may be detachably connected to one another, for instance via hook and fabric loop members, snap fasteners, one or more zippers, etc.

Figure 2:
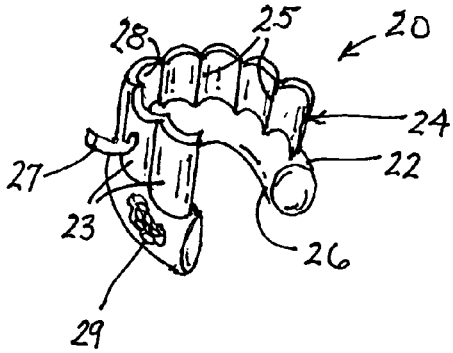
FIG. 2 is a schematic perspective view of a second embodiment of a combined neck rest and head support in accordance with the present invention.

FIG. 2 shows a neck and head rest assembly 20 including a neck rest 22 with an attached head support 24. Neck rest 22 takes the form of a generally U- or C-shaped body member defining a recess or cutout 26 for receiving a user's neck. Head support 24 is attached to neck rest 22 along one side thereof and comprises an inflatable balloon or bladder body member that has a fluted, scalloped, or ribbed configuration that provides reinforcement or added strength for enhanced support. More particularly, head support 24 includes, in an inflated or expanded configuration, a series of cylindrically arcuate segments 23 that are concave either on an inwardly or outwardly facing side, the arcuate segments being connected to one another along vertical (during use) seams or ribs 25.

Neck rest 22 extends generally in a plane, while seams or ribs 25 of head support 24 extend substantially perpendicularly to that plane. Seams or ribs 25 divide head support 24 and form compartmentalized cylindrically arcuate segments 23. FIG. 2 shows segments 23 as being concave on an inward side, defining a recess 28 that receives at least a lower portion of a user's head. Alternatively, compartments or segments 23 may be convex in an inner side facing the user's head and concave or convex on an outer side facing away from the user's head.

As depicted in broken-away view in FIG. 2, neck rest 22 is filled with a fluidic particulate material such as natural or artificial beans 29. The artificial material may be polymeric foam material. In addition, head support 24 is provided with an inflation tube 27 for enabling a user to pressurize compartments or segments 23. To that end, each or rib 25 is formed with a gap (not shown) that enables communication between adjacent compartments or segments 23, so that one inflation tube 27 suffices for the entire head support 24.

Generally, head support 24 has a height (equivalent to the lengths of seam or ribs 25), measured transversely to the plane of neck rest 22, that is greater than the height of neck rest 22, also measured transversely to the plane of neck rest 22. This is to provide an enhanced degree of support for the user's head.

Figure 3:
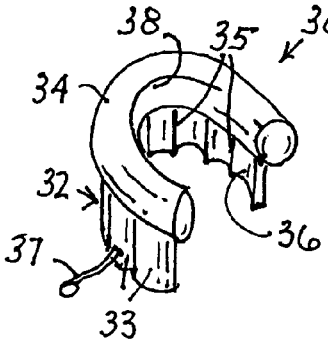
FIG. 3 is a schematic perspective view of a third embodiment of a combined neck rest and head support in accordance with the present invention.

FIG. 3 shows an alternate embodiment that is essentially an inversion of the embodiment of FIG. 2. Thus, a neck and head rest assembly 30 as shown in FIG. 3 includes a neck rest 32 and a head support 34, where the head support is a generally U- or C-shaped body member defining a recess or cutout 38 for receiving at least a lower portion of a user's head and where the neck rest 32 comprises an inflatable balloon or bladder body member that has a fluted, scalloped, or ribbed configuration. More particularly, neck rest 32 includes a series of cylindrically arcuate segments 33 that are concave either on an inwardly or outwardly facing side, the arcuate segments being connected to one another along vertical (during use) seams or ribs 35.

Head support 34 extends generally in a plane, while seams or ribs 35 of neck rest 32 extend substantially perpendicularly to that plane. Seams or ribs 35 divide neck rest 32 and form compartmentalized cylindrically arcuate segments 33. FIG. 3 shows segments 33 as being concave on an inward side, defining a recess 36 that receives a user's neck. Alternatively, compartments or segments 33 may be convex in an inner side facing the user's head and concave or convex on an outer side facing away from the user's head.

Head support 34 may be filled with a fluidic particulate material such as natural beans or artificial beans 30 of polymeric foam material. In addition, neck rest 32 is provided with an inflation tube 37 for enabling a user to pressurize compartments or segments 33. To that end, each or rib 35 is formed with a gap (not shown) that enables communication between adjacent compartments or segments 33, so that one inflation tube 39 suffices for the entire neck rest 32.

Figure 4:
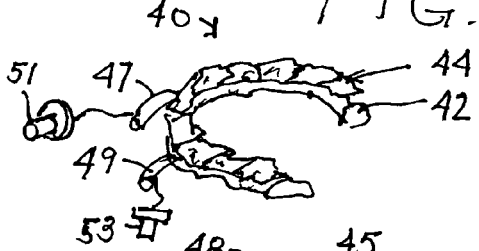
FIG. 4 is a schematic perspective view of a fourth embodiment of a combined neck rest and head support in accordance with the present invention, showing the combined neck rest and head support in a deflated or collapsed storage configuration.
Figure 5:
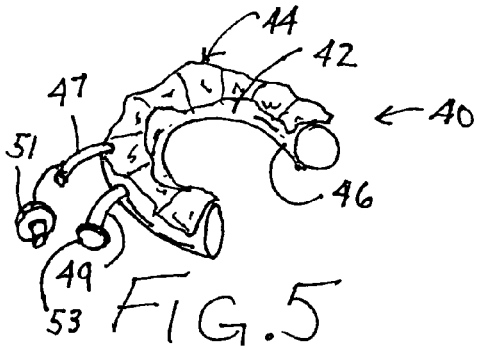
FIG. 5 is a schematic perspective view of the embodiment of FIG. 4, showing the combined neck rest and head support in a first partially expanded use configuration.
Figure 6:
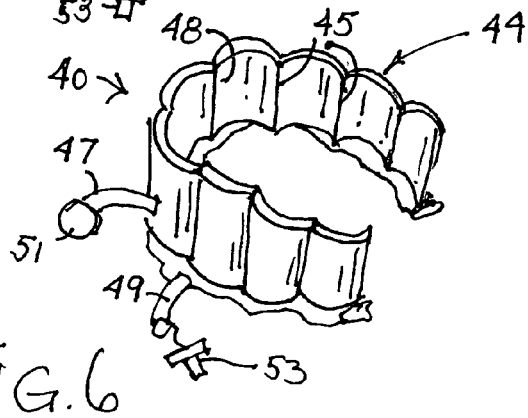
FIG. 6 is a schematic perspective view of the embodiment of FIG. 4, showing the combined neck rest and head support in a second partially expanded use configuration.

FIGS. 4-6 illustrate an embodiment of the invention where both body members are inflatable and have respective air inlet ports.

Per FIGS. 4-6, a neck and head rest assembly 40 includes a neck rest 42 with an attached head support 44. Neck rest 42 has a balloon or bladder body member (not separately designated) that is inflatable from a collapsed configuration 52 (FIGS. 4 and 6) to an expanded U- or C-shape that defines a recess or cutout 46 for receiving a user's neck. Head support 44 is attached to neck rest 42 along one side thereof and substantially coextensively therewith along the U- or C-shaped extent of the neck rest. Head support 44 comprises an inflatable balloon or bladder body member (not separately designated) that has a fluted, scalloped, or ribbed configuration that provides reinforcement or added strength for enhanced support. More particularly, head support 44 includes, in an inflated or expanded configuration (FIG. 6), a series of cylindrically arcuate segments 43 that are concave either on an inwardly (depicted) or outwardly facing side, the arcuate segments being connected to one another along substantially vertical (during use of the device) seams or ribs 45.

The inflated configuration of neck rest 42 (FIG. 5) extends generally in a plane, while seams or ribs 45 of head support 44 extend substantially perpendicularly to that plane. Seams or ribs 45 divide head support 44 and form compartmentalized cylindrically arcuate segments 43. FIG. 6 shows segments 43 as being concave on an inward side, defining a recess 48 that receives at least a lower portion of a user's head. Alternatively, compartments or segments 43 may be convex in an inner side facing the user's head and concave or convex on an outer side facing away from the user's head.

Head support 44 is provided with an inflation tube 47 for enabling a user to pressurize compartments or segments 43. To that end, each or rib 45 is formed with a gap (not shown) that enables communication between adjacent compartments or segments 43, so that one inflation tube 47 suffices for the entire head support 44.

Similarly, neck rest 42 is provided with an inflation tube 49 for enabling a user to pressurize and expand the body member of the neck rest to an inflated configuration as shown in FIG. 5.

Generally, head support 44 has a height (equivalent to the lengths of seam or ribs 45), measured transversely to the plane of neck rest 42, that is greater than the height of neck rest 42, also measured transversely to the plane of neck rest 42. This is to provide an enhanced degree of support for the user's head.

As indicated in FIG. 4, the neck and head rest assembly 40 has a completely deflated configuration for storage and transport. FIG. 5 shows neck rest 42 in an inflated configuration and head support 44 in a deflated or collapsed configuration. The partially expanded configuration of FIG. 5 is useful where the user desires only neck support, for instance, when watching a video or film during an airplane flight. FIG. 6 shows neck rest 42 in a collapsed state and head rest 44 in an expanded state. The partially expanded configuration of FIG. 6 provides an alternative neck rest.

Inflation tubes 47 and 49 are provided with respective tethered plugs 51 and 53 for stopping up the tubes in the case that the user wished to have neck rest 42 and/or head support 44 in an inflated configuration. Similar plugs or stoppers (not shown) are provided for inflation tubes 27 and 37.

Although the invention has been described in terms of particular embodiments and applications, one of ordinary skill in the art, in light of this teaching, can generate additional embodiments and modifications without departing from the spirit of or exceeding the scope of the claimed invention. For instance, the head supports 14, 24, 34, and 44 may be detachably connected to the respective neck rests 12, 22, 32, and 42. The separable couplings may be implemented by snap-lock connectors, hook-and-loop fasteners, releasable adhesive strips, magnets, etc. Accordingly, it is to be understood that the drawings and descriptions herein are preferred by way of example to facilitate comprehension of the invention and should not be construed to limit the scope thereof.

What is claimed is:

1. A neck rest assembly comprising: a first body member having a first recess for receiving a user's neck, said first body member defining a cushion extending around said recess for at least partially surrounding the user's neck; and a second body member different from said first body member and connected to said first body member, said second body member defining a second recess for receiving at least a lower portion of the user's head, said second body member defining a cushion extending around said second recess for at least partially surrounding said lower portion of the user's head, one of said first body member and said second body member having an arcuate form extending in a plane, the other of said first body member and said second body member including a plurality of support ribs extending substantially perpendicularly to said plane.

2. The neck rest assembly according to claim 1 wherein at least one of said first body member and said second body member is an inflatable balloon or bladder.

3. The neck rest assembly according to claim 2 wherein the other of said first body member and said second body member is a bag at least partially filled with flowable solid particles.

4. The neck rest assembly according to claim 3 wherein said bag at least partially filled with said flowable solid particles is said first body member.

5. The neck rest assembly according to claim 4 wherein said first body member extends in said plane, said second body member including said plurality of said support ribs.

6. The neck rest assembly according to claim 5 wherein said support ribs are seams dividing said second body member into a plurality of compartments.

7. The neck rest assembly according to claim 6 wherein said compartments are defined by concave surfaces along an inner side of said second body member, facing into said second recess.

8. The neck rest assembly according to claim 1 wherein said support ribs are seams dividing said second body member into a plurality of compartments.

9. The neck rest assembly according to claim 8 wherein said compartments are defined by concave surfaces along an inner side of said second body member, facing into said second recess.

10. The neck rest assembly according to claim 1 wherein said first body member and said second body member are inflatable balloons or bladders.

11. The neck rest assembly according to claim 10 wherein said first body member and said second body member have respective gas inlets so that said first body member and said second body member are separately inflatable.

12. The neck rest assembly according to claim 11 wherein said first body member and said second body member are detachably connected to one another.

13. The neck rest assembly according to claim 10 wherein said first body member and said second body member share a single gas inlet so that said first body member and said second body member are jointly inflatable.

14. The neck rest assembly according to claim 1 wherein said first body member is a C-shaped member having a first height, said second body member having a semi-cylindrical shape with a second height greater than said first height.

15. The neck rest assembly according to claim 10 wherein said first body member and said second body member are detachably connected to one another.

16. A neck rest assembly comprising:

a first body member having a first recess for receiving a user's neck, said first body member defining a cushion extending around said recess for at least partially surrounding the user's neck; and a second body member different from said first body member and connected to said first body member, said second body member defining a second recess for receiving at least a lower portion of the user's head, said second body member defining a cushion extending around said second recess for at least partially surrounding said lower portion of the user's head, wherein said first body member and said second body member are inflatable balloons or bladders and wherein said first body member and said second body member share a single gas inlet so that said first body member and said second body member are jointly inflatable.

17. The neck rest assembly according to claim 16 wherein said first body member is a C-shaped member having a first height, said second body member having a semi-cylindrical shape with a second height greater than said first height.

* * * * *